US006410874B2

(12) United States Patent
Marin-Pache et al.

(10) Patent No.: US 6,410,874 B2
(45) Date of Patent: Jun. 25, 2002

(54) BREAKING MODULE COMPRISING A VACUUM CARTRIDGE AND FIXING MEANS, AND AN ELECTRICAL SWITCHGEAR APPARATUS COMPRISING SUCH A MODULE

(75) Inventors: Reynald Marin-Pache, Biviers; Thierry Milan, Grenoble; Denis Milan, Seyssinet, all of (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/793,767

(22) Filed: Feb. 27, 2001

(30) Foreign Application Priority Data

Mar. 31, 2000 (FR) ..... 00 04166

(51) Int. Cl.[7] ..... H01H 33/66

(52) U.S. Cl. ..... 218/118; 218/120; 218/140; 218/155

(58) Field of Search ..... 218/118, 120, 218/121, 134–137, 139–140, 155

(56) References Cited

U.S. PATENT DOCUMENTS

| | | | | |
|---|---|---|---|---|
| 4,434,331 A | * | 2/1984 | Sakuma et al. | 335/151 |
| 4,527,028 A | | 7/1985 | Luehring | |
| 4,933,518 A | | 6/1990 | Yin | |
| 5,864,108 A | * | 1/1999 | Rohling et al. | 218/134 |

FOREIGN PATENT DOCUMENTS

| | | |
|---|---|---|
| EP | 0 054 671 A2 | 10/1981 |
| EP | 0 058 519 A2 | 2/1982 |

* cited by examiner

*Primary Examiner*—Lincoln Donovan
(74) *Attorney, Agent, or Firm*—Parkhurst & Wendel, L.L.P.

(57) ABSTRACT

A breaking module for an electrical switchgear apparatus comprises a vacuum cartridge comprising a body and a support frame of the cartridge. The cartridge is provided with a metal rod movable in translation and driving a movable contact. A collar both performs radial positioning of the body of the cartridge with respect to the frame and constitutes a guide sheath of the rod. For fitting, the collar can be opened so as to insert the rod radially therein. Once the body of the cartridge has been encircled, the collar is inserted radially in guide grooves of the frame.

9 Claims, 5 Drawing Sheets

BREAKING MODULE COMPRISING A VACUUM CARTRIDGE AND FIXING MEANS, AND AN ELECTRICAL SWITCHGEAR APPARATUS COMPRISING SUCH A MODULE

BACKGROUND OF THE INVENTION

The invention relates to a module for an electrical switchgear apparatus, comprising a vacuum cartridge and means for fixing the cartridge to a support frame. It also relates to a switchgear apparatus comprising at least one such module.

Conventionally, a vacuum cartridge comprises a body forming a tight enclosure and housing a pair of separable contacts. with at least one movable contact. The movable contact is securedly affixed to a metal rod movable in translation parallel to its axis and protruding out from a first axial end of the cartridge. Tightness is achieved between the rod and a wall of the enclosure by means of a sealing bellows allowing translation movement of the rod. This rod is designed to be connected to a drive mechanism of the cartridge. The other contact is in general a stationary contact securedly affixed to a fixed rod passing through the body of the cartridge so as to be accessible from the outside at a second axial end of the cartridge, opposite the first end. The movable rod is guided in its axial movement with respect to the cartridge by means of a guide sleeve forming an integral part of the body of the cartridge and protruding towards the inside of the cartridge. Various embodiments of this architecture are illustrated in the documents DE 2,440,827, U.S. Pat. Nos. 4,403,124, 4,933,518, 4,983,793, 5,004,877 and 5,168,139.

A three-phase electrical switchgear apparatus is described in the document EP 0,058,519, each phase of which apparatus comprises a vacuum cartridge of the previously mentioned kind supported by a rigid frame made of insulating material. On the side where the first axial end is situated, the body of the cartridge is fixed to the frame by means of a support plate provided with a bore at the diameter of the first axial end and forming a seat for the body of the cartridge. On the side where the second axial end is situated, the body of the cartridge is fixed to the frame by means of a fixing nut of the rod fixed to an electrical connecting strip securedly affixed to the frame. There is no interaction between the support plate and the rod.

A flexible electrical connection is fixed to the free end of the rod by hooping. When the apparatus is assembled, the hooping operation of the connection necessarily takes place after the cartridge has been fitted on the support plate, as the hooped connection is too bulky to pass through the bored hole of the support plate. Moreover, positioning of the cartridge on its frame has to be performed with precision in order not to force the movable contact rod out of its translation axis determined by the guide sleeve internal to the cartridge. These points prove to be disadvantageous for industrialization of the apparatus.

OBJECT OF THE INVENTION

One object of the invention is to facilitate assembly of an electrical switchgear apparatus with a vacuum cartridge, and in particular assembly of the breaking module formed by the cartridge and its support frame.

For this purpose, the object of the invention is to provide a breaking module for an electrical switchgear apparatus, comprising:

at least one vacuum cartridge comprising a body forming an enclosure containing a pair of separable contacts, one of said contacts being securedly affixed to a movable metal rod, a part of the rod protruding out from the enclosure at a first axial end of the body of the cartridge;

a support frame of the cartridge;

a fixing and guiding collar comprising:

an aperture forming an axial guide sheath of the rod of the cartridge, performing guiding of the rod in translation with respect to the collar according to a geometric axis of the aperture;

radial positioning surfaces co-operating with the body of the cartridge and preventing any radial movement of the body of the cartridge with respect to the geometric axis of the aperture of the collar;

means for fixing to the support frame of the cartridge.

The collar enables both guiding of the rod with respect to the cartridge and fixing of the cartridge with respect to the frame. The chain of dimensions is thereby reduced, resulting in a greater guiding precision, achieved at low cost.

Advantageously, the frame is equipped with guiding slides and the collar is in the form of a slide-rack so as to slide in said guiding slides in a direction perpendicular to the geometric axis of the aperture. It is then possible to assemble the cartridge and its collar before inserting the assembly in the frame, by sliding the collar in the slides. According to one embodiment, the means for fixing comprise elastic clips forming a fixing means by clipping. This fixing mode by clips makes assembly particularly simple. The clips are preferably situated on the collar and co-operate with bearing surfaces situated on the frame.

Preferably, the collar is composed of two parts able to take an open position with respect to one another enabling radial insertion of the rod of the cartridge and a closed position wherein the radial positioning surfaces co-operate with the body of the cartridge and the aperture co-operates with the rod. This particularly advantageous arrangement enables fitting of the flexible conductor on the rod of the cartridge to be performed before the collar is fitted to fix the cartridge in its frame. According to a preferred embodiment, the two parts of the collar are articulated on one another by a hinge. The two parts of the collar in the closed position are secured to one another by fixing means. These arrangements make assembly easier.

Preferably, the collar is provided with axial positioning surfaces forming a seat for a section of axial end of the body of the cartridge. Positioning of the collar is thereby simplified.

According to one embodiment, the collar is made of plastic material, which may for example be a 6—6 polyamide.

Preferably, the module comprises a single vacuum cartridge.

According to another feature of the invention, the object of the invention is also to achieve an electrical switchgear apparatus comprising at least one module as described in the above, and a drive mechanism of the rod of said module.

BRIEF DESCRIPTION OF THE DRAWINGS

Other advantages and features will become more clearly apparent from the following description of a particular embodiment of the invention, given as a non-restrictive example only and represented in the accompanying drawings in which.

DETAILED DESCRIPTION OF THE PREFERRED EMBODIMENT

Figure 1:
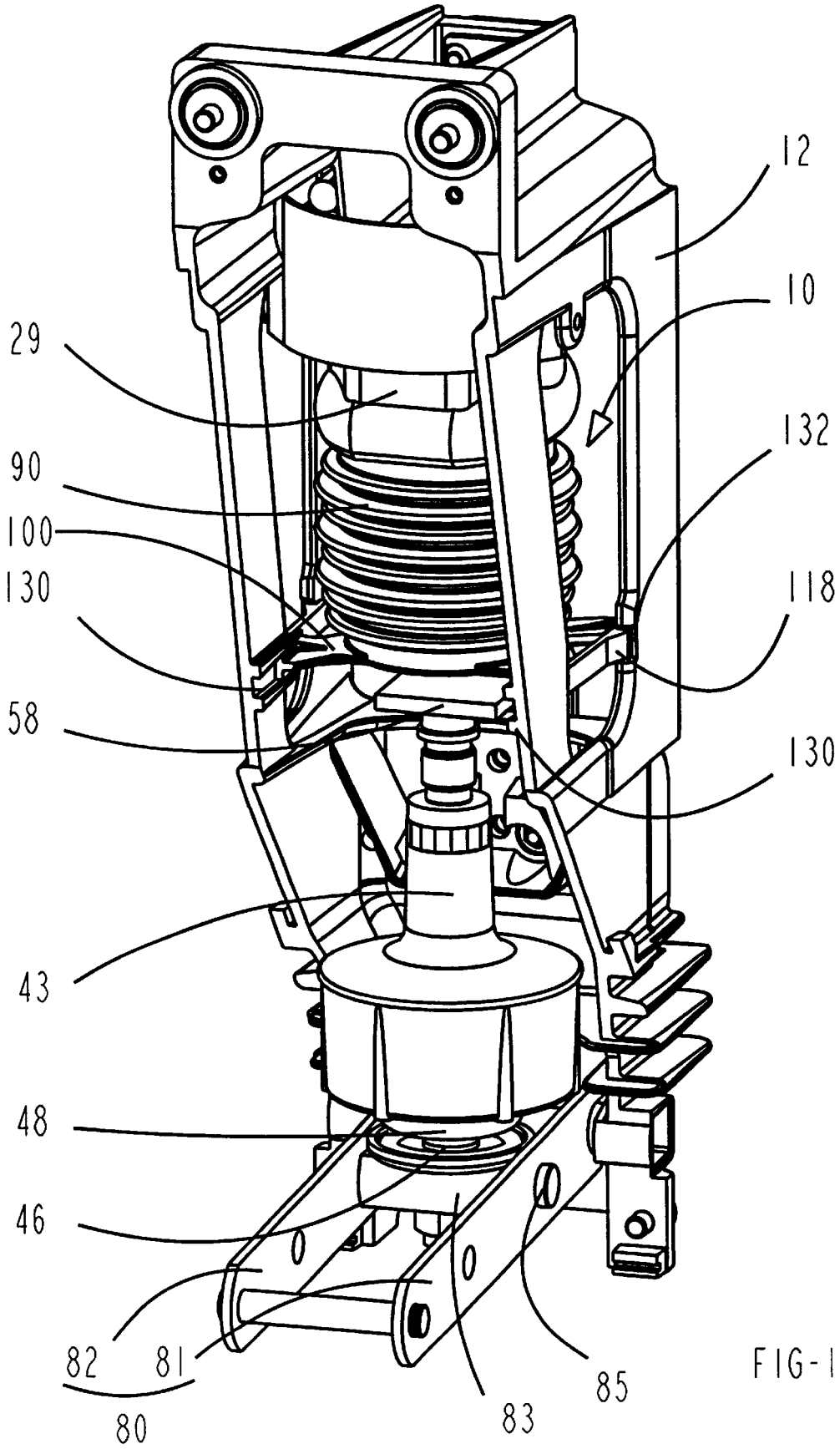
FIG. 1 represents a perspective view of a switchgear apparatus according to the invention, comprising a vacuum cartridge fitted in a support frame.
Figure 2:
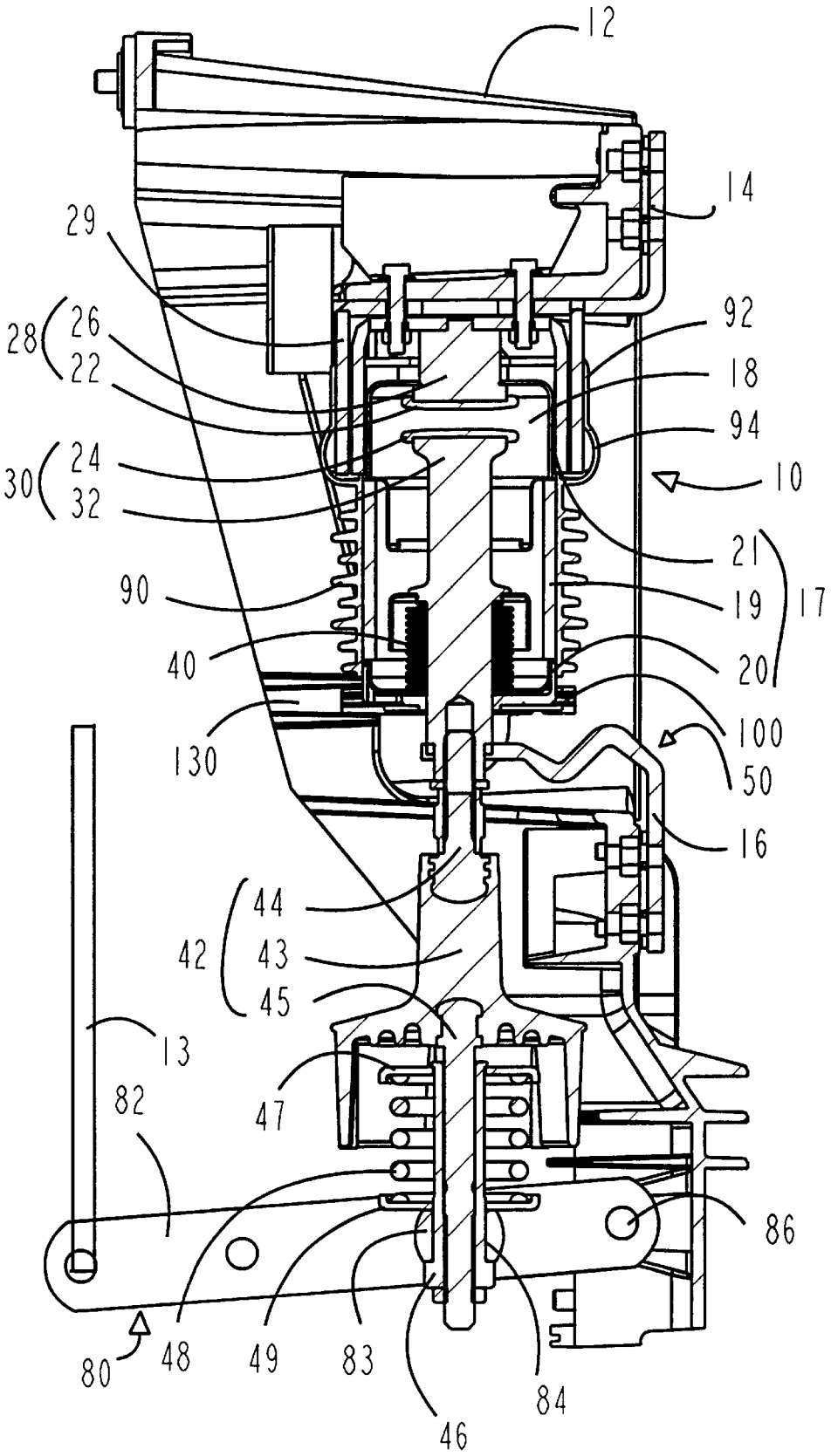
FIG. 2 represents an axial cross-sectional view of the switchgear apparatus of FIG. 1.

With reference to FIGS. 1 and 2, a switchgear apparatus comprises a vacuum cartridge 10 supported by a frame 12 and driven by a mechanism 13 of conventional type. Two connecting strips 14 and 16, fixed to the frame 12, are designed to connect the apparatus electrically to a busbar (not represented).

The generic expression vacuum cartridge is used here to designate an assembly of known type, comprising a cylindrical body 17 forming an enclosure 18 wherein a relative vacuum prevails and housing a pair of separable contacts 22, 24. The body 17 is itself divided into a middle insulating section 19 made of insulating material, a first metal end section 20 forming a first closing flange, and a second metal end section 21 forming a second closing flange. One of the contacts is a pad 22 brazed onto the end of a conducting cylinder 26 and forms a stationary contact means 28 with this cylinder. The cylinder 26 passes through the second flange 21 and is welded to the latter. The cylinder 26 is also welded onto a rigid metal coil 29, itself welded to the connecting strip 14. An electrical connection is thus achieved between the stationary contact means 28 and the connecting strip 14, by means of the coil 29. The coil 29 is designed to induce a magnetic field, in the separation zone of the contacts 22, 24, favorable to breaking of an electric arc arising between the contacts when separation of the latter takes place. Screws perform fixing of the coil 29 to the frame 12, and therefore rigid fixing between the cylinder 26, itself fixedly secured to the body 17 of the cartridge, and the frame 12. Moreover, and as will be explained in detail further on, the first flange 20 is positioned and secured with respect to the frame 12 by means of a fixing collar 100 secured in a groove 130 of the frame.

The contact 24 is a pad brazed onto the end of a movable contact means 30 whose body is formed by a metal conducting rod 32, in this instance a copper rod, passing through an orifice of the first flange 20. This rod 32 is extended outside the enclosure, as can be seen more clearly in FIG. 5, by a part 36 of smaller diameter, thus defining an intermediate shoulder 38. The end of the rod is provided with an axial tapped hole 39. A sealing bellows 40 brazed onto the rod 32 and onto the internal wall of the first end section allows an axial translation movement of the movable contact means 30 with respect to the stationary contact means 28, while preserving the vacuum prevailing in the enclosure 18.

The rod 32 is connected to a lever 80 with two parallel arms 81, 82, by means of an insulating arm 42. The insulating arm 42 comprises a body made of plastic material 43 overmolding on the one hand the head of a first threaded rod 44, and on the other hand the head of a second threaded rod 45 situated in the axial extension of the first rod 44. The first threaded rod 44 is screwed into the tapped blind hole 39 situated at the end of the rod 32 of the cartridge. A tubular adjusting nut 46 is screwed onto the second threaded rod 45. The nut supports at one end a support seat 47 for the end of a contact pressure spring 48. The other end of the spring 48 bears on a second support seat 49, which rests on a bar 83. The bar 83 comprises a bore 84 forming a guide sheath through which the tubular nut 46 passes. The bar 83 rotates freely in lateral spindles 85 supported by the arms 81, 82 of the lever 80. The guide sheath 84 allows both translation of the nut 46 parallel to its axis and free rotation of this nut. The nut 46 comprises a shoulder resting on the bar part 83 opposite the second support seat 49. The two arms 81, 82 of the lever 80 pivot around a spindle 86 supported by the frame 12 and are actuated jointly at their free end by a closing and opening mechanism (not represented), this mechanism being designed to drive the movable contact means 30 between a position in contact with the stationary contact means 28 and a separated position. When opening takes place, the lever 80 pivots counter-clockwise around the spindle 86 in FIG. 2, driving the bar 83, the nut 46, the arm 42 and the movable contact means 30 directly. When closing takes place, the lever 80 pivots clockwise around the spindle 86, driving the bar 83 which compresses the spring 48 by means of the support seat 49. The closing force is then transmitted by the spring 48 to the movable contact 30 by means of a transmission system comprising the support seat 47, the nut 46 and the insulating arm 42.

Figure 3:
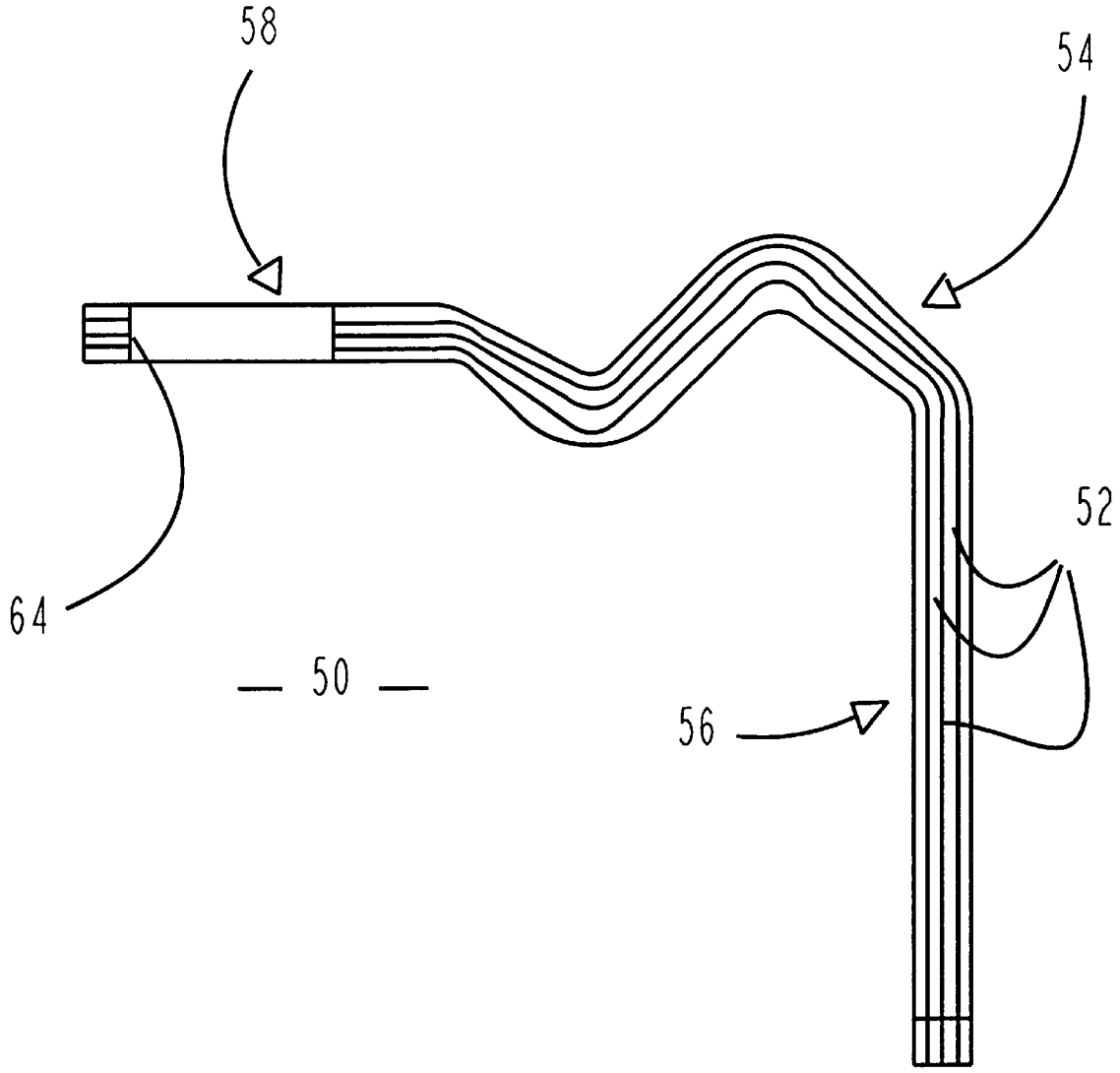
FIG. 3 represents a flexible electrical connector enabling an electrical connection to be made between the cartridge and a connecting strip.
Figure 4:
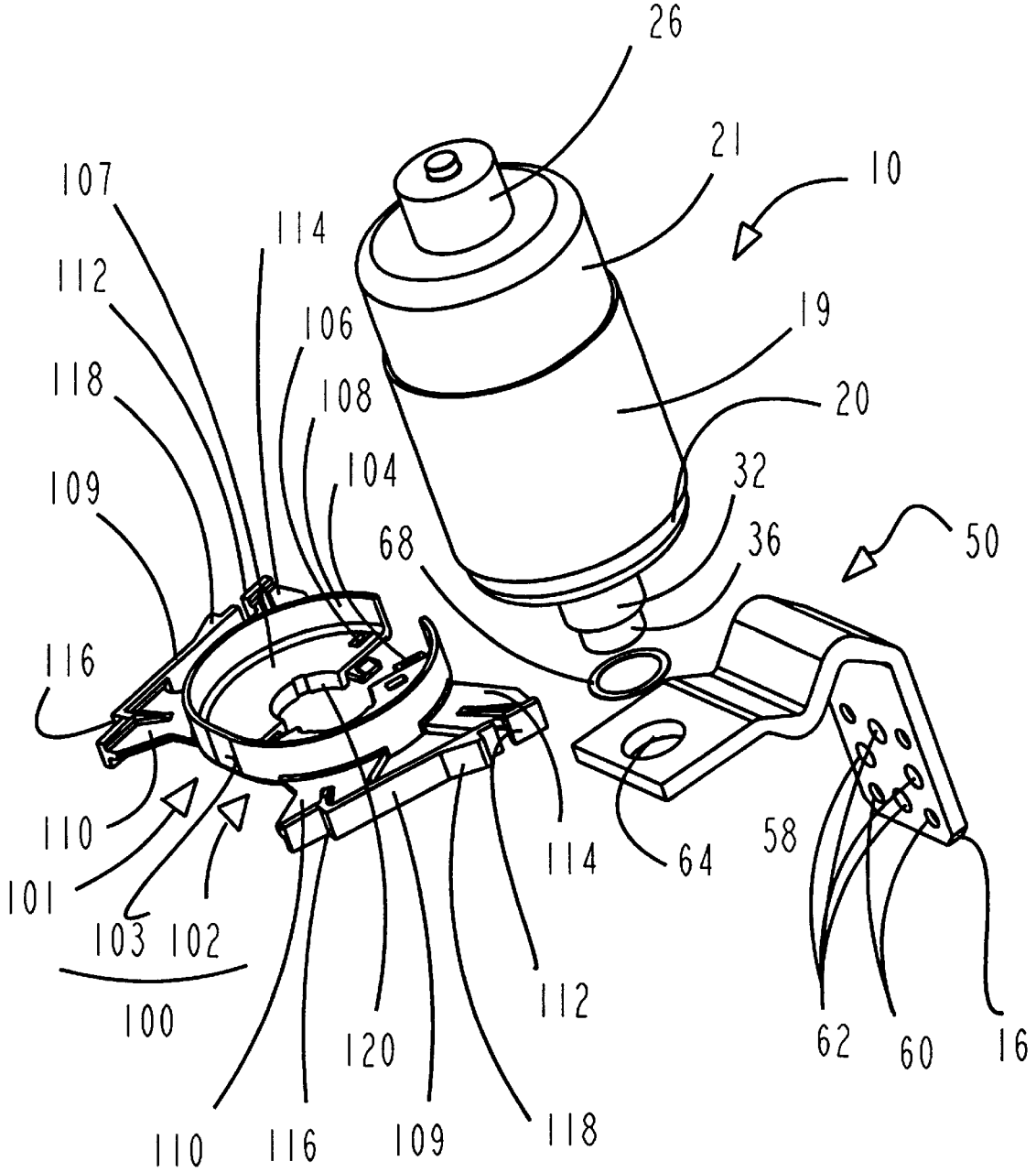
FIG. 4 represents an exploded view of a part of the switchgear apparatus before assembly thereof.

Electrical connection of the rod 32 to the busbar is performed by means of a flexible electrical connection 50, represented schematically in FIG. 3, one end 56 of which connection constitutes the connecting strip 16, whereas the other end 58 of the connection is brazed onto the body of the rod 32. The flexible connection 50 is formed by a stack of metal blades 52, in this instance copper blades. Each metal blade 52 comprises a curved middle part 54 extended at each end by one of the flat end parts 56, 58. The blades 52 have different lengths and shapes so as to form together a stack having the required curved shaped at the level of the middle part 54. At the level of the ends 56, 58, the blades 52 are welded to one another by an atomic diffusion welding process, without any added material, so that each end constitutes a rigid monoblock part. In their middle part 54, the blades 52 remain separated from one another, which gives the electrical connection 50 thus formed a good overall flexibility. As illustrated in FIG. 4, the end part 56 constituting the connecting strip comprises fixing means 60, in the form of open tapped holes, for fixing of the connecting strip to the switchgear apparatus frame, and connection means 62, in the form of other tapped holes, for connection to a busbar. The other end part 58 comprises a bore 64 corresponding to the diameter of the spindle of the rod 36.

The collar 100, which can be seen in detail in FIG. 4, is made of plastic material, in this instance a 6–6 polyamide, and comprises two parts 101, 102 articulated on one another by a hinge 103 so as to be able to take an open assembly position represented in FIG. 4, and a closed position represented in FIG. 2, in which elastic hooks 104 clip into corresponding apertures 106. The closed collar forms a flange having a flat bottom 107 and a cylindrical peripheral wall 108 enabling the end of the first flange 20 of the cartridge 10 to be engaged therein. The center part of the flat bottom comprises an aperture 120 for the rod 32 of the cartridge to pass through. This aperture, of general cylindrical shape, performs guiding of the rod 32. The collar 100 is provided with two main side rails 109, connected to the flat bottom 107 by two side flanges 110, and two auxiliary side rails 112 connected to the flat bottom 107 by two other side flanges 114. Each auxiliary rail 112 is located in the extension of one of the main rails 109. Each main rail 109 forms a staggered stop 116 in a front part and an elastic clip 118 in a rear part.

The insulating section 19 of the body 17 of the cartridge is covered by an insulating sleeve 90 (FIG. 2) equipped with fins designed to increase the creepage distance between the live metal parts of the apparatus. The sleeve 90 widens out in its upper part and forms a lip 92 which overlaps a part of the coil 29, so as to increase the distance between the live metal parts. An intermediate padding 94, whose internal surface is covered with semiconducting paint, smoothes the field lines close to the edges of the coil 29.

The body made of plastic material 43 of the insulating arm 42 forms a cylindrical skirt which protects the spring 48 and the threaded rod 45 and which thus performs the electrical insulation between the rod 32 and the flexible connection 50 on the one hand, and the mechanism on the other hand.

Fitting of the cartridge 10 in the frame 12 is performed in the following manner. In a first step, the cylinder 26 is welded to the sub-assembly formed by the coil 29 and the connecting strip 14. The insulating sleeve 90 is then engaged forcibly onto the body 17 of the cartridge and onto the coil 29.

Figure 5:
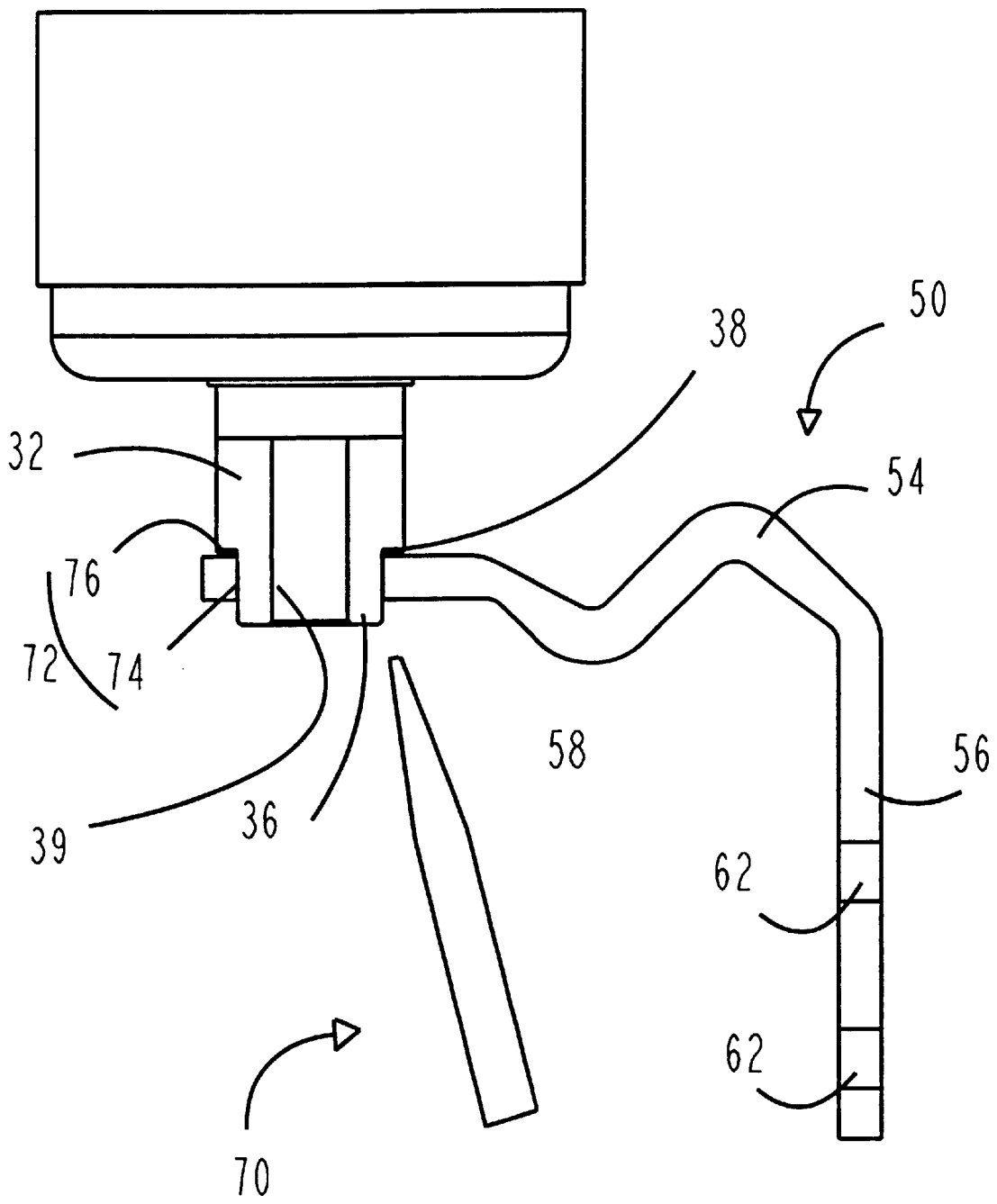
FIG. 5 schematically represents a brazing operation making a junction between a rod of the cartridge and the flexible electrical connector.

The cartridge 10 then has to be equipped with its electrical connection 50. The spindle 36 of the rod 32 is inserted in the bore 64, with an interposed washer made of metallic filler compound 68, according to the exploded drawing of FIG. 3. The metallic filler compound must have a relatively low melting temperature, preferably less than 700° C., so as not to damage the internal brazings of the cartridge. The compound involved in this instance is for example 56% silver, 22% copper, 17% zinc and 5% tin, having a melting point of about 650° C. A heat source 70, represented schematically in FIG. 5, is provided at the free end of the bore until melting of the washer 68 and axial infiltration by capillarity of a part of the metallic filler compound into the cylindrical space at the interface between the bore and the spindle is achieved. In a manner well known to a brazing specialist. the initial clearance between the parts, i.e. between the bore and the spindle, must be suitably chosen on the one hand to foster wetting of the surfaces to be assembled, when brazing takes place, and on the other hand to ensure the mechanical strength of the brazed joint under subsequent conditions of use. The brazed joint 72 obtained reveals on the one hand a cylindrical interface zone 74 between the bore and the spindle, and on the other hand an annular interface zone 76 between the top edge of the bore 64 and the shoulder 38 of the rod.

When this assembly has been completed, the rod 32 is inserted radially into the open collar 100, and the collar 100 is then closed so as to encircle the end of the first flange 20 of the body 17 of the cartridge and the rod 32, the elastic hooks 104 clipping into corresponding apertures 106. The assembly thus formed is then inserted laterally into the frame 12, the rails 109 being inserted in the lateral grooves 130 and forming a sliding guide with these grooves. The collar then forms a slide rack which slides in the grooves 130 until the stops 116 encounter corresponding surfaces of the frame, the clips 118 then closing on corresponding bearing surfaces 132 of the frame.

It then simply remains to secure the connecting strips 14, 16 and the coil 29 to the frame 12, to screw the insulating arm into the tapped hole of the rod and to adjust the contact pressure by means of the adjusting nut.

Strictly speaking, the movement transmitted to the rod 32 of the cartridge 10 by the lever 80 in the absence of clearance between the moving parts would not be perfectly straight with respect to the frame 12. However, the angle between the lever 80 and the rod 32 is always very close to a right angle, and the travel of the rod 32 of the cartridge between its open position and its closed position does not exceed a few millimeters, which corresponds to an angle of rotation of the lever 80 not exceeding a few degrees, so that in the absence of clearance, the radial movement of the rod 32 would be about one hundredth of its axial travel. In the described embodiment, this movement is absorbed by the clearances existing between the various elements of the transmission system, in particular at the level of the gudgeons 85 and the spindle 86. However, if a greater travel was required, it would be possible to guide the bar 126 in an oblong of the lever 90, 92, 94.

The sub-assembly thus constituted forms a module which can be assembled and tested in the plant before being stored independently from the mechanism 13. Final assembly of the switchgear apparatus can be deferred. The modules enable switchgear apparatuses to be constituted differing from one another by the number of poles arranged side by side.

Various variations are naturally possible.

The guiding by slides can be reversed, so that rails formed on the frame co-operate with grooves formed at the periphery of the collar. The fixing mode by elastic clips can be replaced by any other suitable fixing mode. The hinge can be omitted, so that the collar is made up of two parts completely separated from one another in the open position. Other modifications are possible. For example, the sleeve can be omitted if the voltage applied permits. The transmission lever can be arranged so that its pivot is between the free end moved by the mechanism and the bar.

As has already been said, the apparatus can be single-pole or multi-pole. In the latter case, the frame can be common to the different poles arranged side by side. However, it is advantageous to arrange single-pole modules each having an independent frame, which favors a very great modularity. The mechanism can be of any known type enabling the lever 80 to be driven: electromagnet, pole shaft mechanism. The switchgear apparatus can be of any type, for example: a switch, or circuit breaker, with or without disconnection features. The vacuum cartridge can comprises two movable contact means.

What is claimed is:

1. A breaking module for an electrical switchgear apparatus, comprising:

at least one vacuum cartridge including a body containing a pair of separable contacts, one of said contacts being securely affixed to a movable metal rod, a part of the rod protruding outwardly from an axial end of the body;

a support frame provided with guiding slides;

a fixing and guiding collar having an aperture having a geometric axis and forming an axial guide sheath for guiding the rod in translation with respect to the collar along the geometric axis, the collar having slide portions that slide in said guiding slides in a direction perpendicular to the geometric axis of the aperture, and radial positioning surfaces cooperating with the body and preventing radial movement of the body with respect to the geometric axis; and elastic clips operable for fixing the collar to the support frame.

2. A breaking module for an electrical switchgear apparatus, comprising:

at least one vacuum cartridge including a body containing a pair of separable contacts, one of said contacts being securedly affixed to a movable metal rod, a part of the rod protruding outwardly from a first axial end of the body;

a support frame;

a fixing and guiding collar made of plastic material located between the support frame and the cartridge, said collar having:

an aperture having a geometric axis and forming an axial guide sheath for guiding the rod in translation with respect to the collar along the geometric axis, and radial positioning surfaces cooperating with the body and preventing radial movement of the body with respect to the geometric axis; and elastic clips operable for fixing the collar to the support frame.

3. A breaking module for an electrical switchgear apparatus, comprising:

at least one vacuum cartridge including a body containing a pair of separable contacts, one of said contacts being securedly affixed to a movable metal rod, a part of the rod protruding outwardly from a first axial end of the body;

a support frame;

a fixing and guiding collar made of plastic material located between the support frame and the cartridge, said collar being composed of two parts movable with respect to one another between an open position and a closed position, said collar having:

guiding surfaces which, in the closed position, form an aperture having a geometric axis and guide movement of the rod with respect to the collar along the geometric axis, and in the open position enable radial insertion of the rod between said guiding surfaces, and radial positioning surfaces which, in the closed position, co-operare with the body and prevent radial movement of the body with respect to the geometric axis; and means for fixing the collar to the support frame.

4. The breaking module according to claim 3, wherein the two parts of the collar are articulated on one another by a hinge.

5. The breaking module according to claim 3, further including a fixing means, wherein the two parts of the collar are secured to one another in the closed position by said fixing means.

6. The breaking module according to claim 1, wherein the collar has axial positioning surfaces forming a seat for receiving a section of the axial end of the body.

7. The breaking module according to claim 1, wherein the collar is made of plastic material.

8. The breaking module according to claim 1, comprising a single vacuum cartridge.

9. The breaking module according to claim 1, comprising:

an electrical switchgear apparatus, wherein at least one said breaking module is adapted to be part of said switchgear apparatus; and a drive mechanism attached to the rod of said at least one breaking module.

* * * * *